US007572144B1

(12) United States Patent
Wu

(10) Patent No.: US 7,572,144 B1
(45) Date of Patent: Aug. 11, 2009

(54) CONNECTOR ADAPTED FOR MOUNTING TO PANEL

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/231,639

(22) Filed: Sep. 3, 2008

(51) Int. Cl.
*H01R 13/73* (2006.01)

(52) U.S. Cl. ..... 439/545; 439/557

(58) Field of Classification Search ..... 439/544, 439/545, 553–559, 247
See application file for complete search history.

(56) References Cited

U.S. PATENT DOCUMENTS

| | | | | |
|---|---|---|---|---|
| 5,199,900 | A * | 4/1993 | Hayes, Sr. | 439/557 |
| 5,800,208 | A * | 9/1998 | Ishizuka et al. | 439/557 |
| 6,579,111 | B2 * | 6/2003 | Fukamachi | 439/247 |
| 6,945,816 | B1 | 9/2005 | Wu | |
| 7,192,307 | B1 * | 3/2007 | Tran et al. | 439/553 |

FOREIGN PATENT DOCUMENTS

| | | |
|---|---|---|
| CN | 2762206 | 3/2006 |

* cited by examiner

*Primary Examiner*—Briggitte R Hammond
(74) *Attorney, Agent, or Firm*—Wei Te Chung

(57) ABSTRACT

A connector (101) adapted for mounting to a panel (200), includes an insulative housing (1) having a mating portion (12), a mounting portion (13) extending rearward from the mating portion, at least a lock tab (132) formed on a top or a bottom surface of the mating portion and disposed adjacent to the mounting portion; a retainer member (15) connected to a lateral side of the insulative housing, said retainer member having a passageway (150) extending along a longitudinal direction and a slit (1521) defined in a lateral side of the retainer member and in communication to the passageway; a slider member (5) including a main portion (50) and a handle portion (530) formed on a lateral side of the main portion, said main portion accommodated in the passageway and the handle portion disposed outside of the passageway and capable of moving along the slit; and a spring member (6) received in the passageway and capable of pushing the main portion sliding along the longitudinal direction to reach a lateral side of the mounting portion.

20 Claims, 7 Drawing Sheets

CONNECTOR ADAPTED FOR MOUNTING TO PANEL

FIELD OF THE INVENTION

The present invention generally relates to a connector, and more particularly to a connector adapted to be mounted to a panel of an electronic device.

DESCRIPTION OF PRIOR ART

A connector is widely applied in an electronic devices, such a computer, sever, etc. One kind of connector is mounted to a panel (side portion) of the electrical device and connected to a cable which is further linked other component inside of the electrical devices, serving as intermediate member and bridging the electronic device and other exterior electronic device.

For example, CN Pat. No. 2762206 discloses a kind of cable assembly attached to a panel of an electronic device, including a connector, a number of cables connected to the connector and further connected to other electronic components, and additional bolts and nuts applied to fasten the connector and the panel together. However, as the electronic device becomes lower profile, and any components thereof are also smaller, so do the bolts and nuts. Thus it is difficult for a user to manually operate the nuts and bolts to fasten the cable assembly to the panel, and tools, such as a screwdriver and a pincers are needed to turn the bolts and hold the nuts. Accordingly, the tools are required to operate the nuts and the bolts to demount the cable assembly from the panel.

Hence, an improved connector is required to overcome aforementioned problems.

SUMMARY OF THE INVENTION

Accordingly, an object of the present invention is to provide a connector which is easily mounted to or demounted from a panel.

In order to achieve the object set forth, a connector in accordance with the present invention comprises an insulative housing including a mating portion, a mounting portion extending rearward from the mating portion, at least a lock tab formed on a top or a bottom surface of the mating portion and disposed adjacent to the mounting portion; a retainer member connected to a lateral side of the insulative housing, said retainer member having a passageway extending along a longitudinal direction and a slit defined in a lateral side of the retainer member and in communication to the passageway; a slider member including a main portion and a handle portion formed on a lateral side of the main portion, said main portion accommodated in the passageway and the handle portion disposed outside of the passageway and capable of moving along the slit; and a spring member received in the passageway and capable of pushing the main portion sliding along the longitudinal direction to reach a lateral side of the mounting portion.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
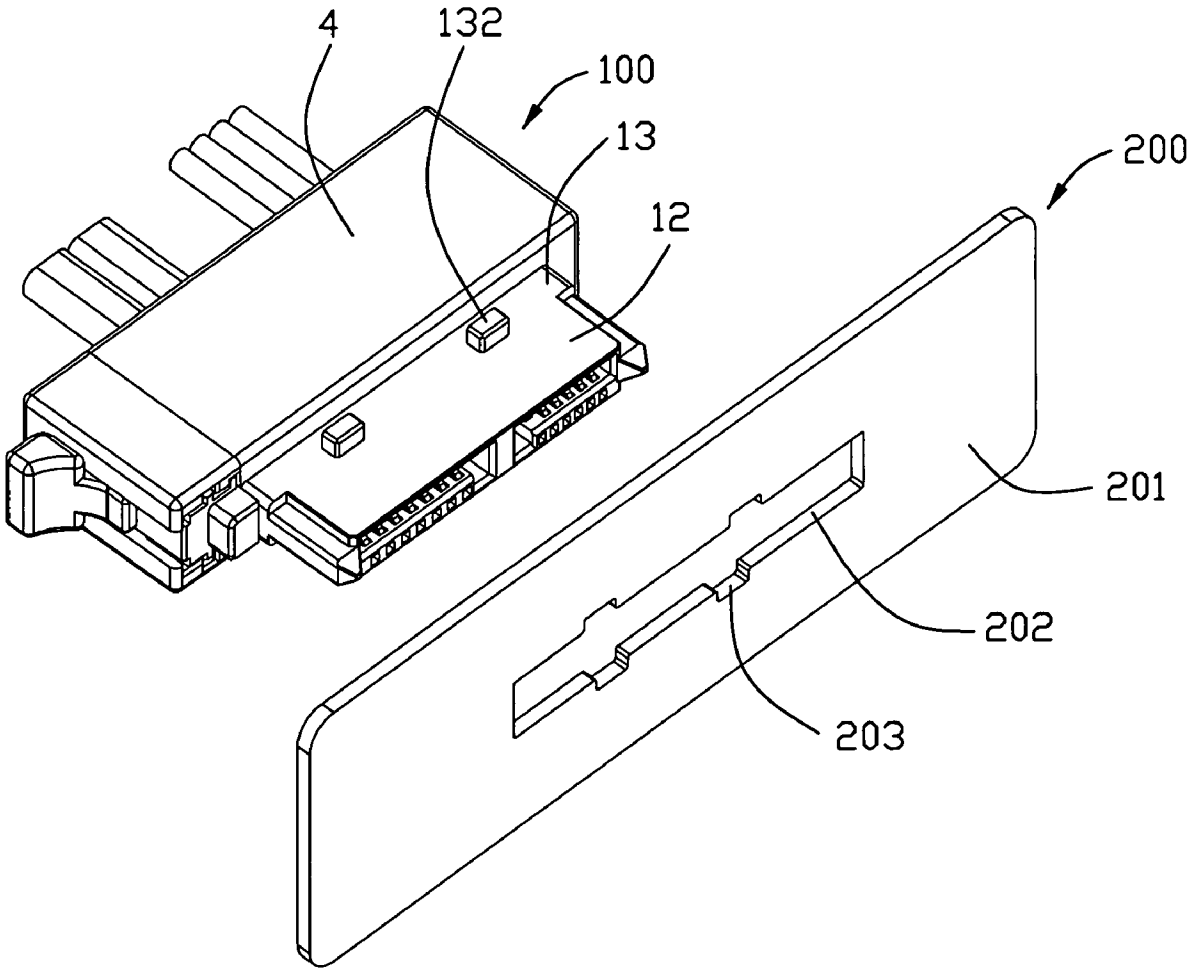
FIG. 1 shows a connector separated from a panel in accordance with the present invention.
Figure 2:
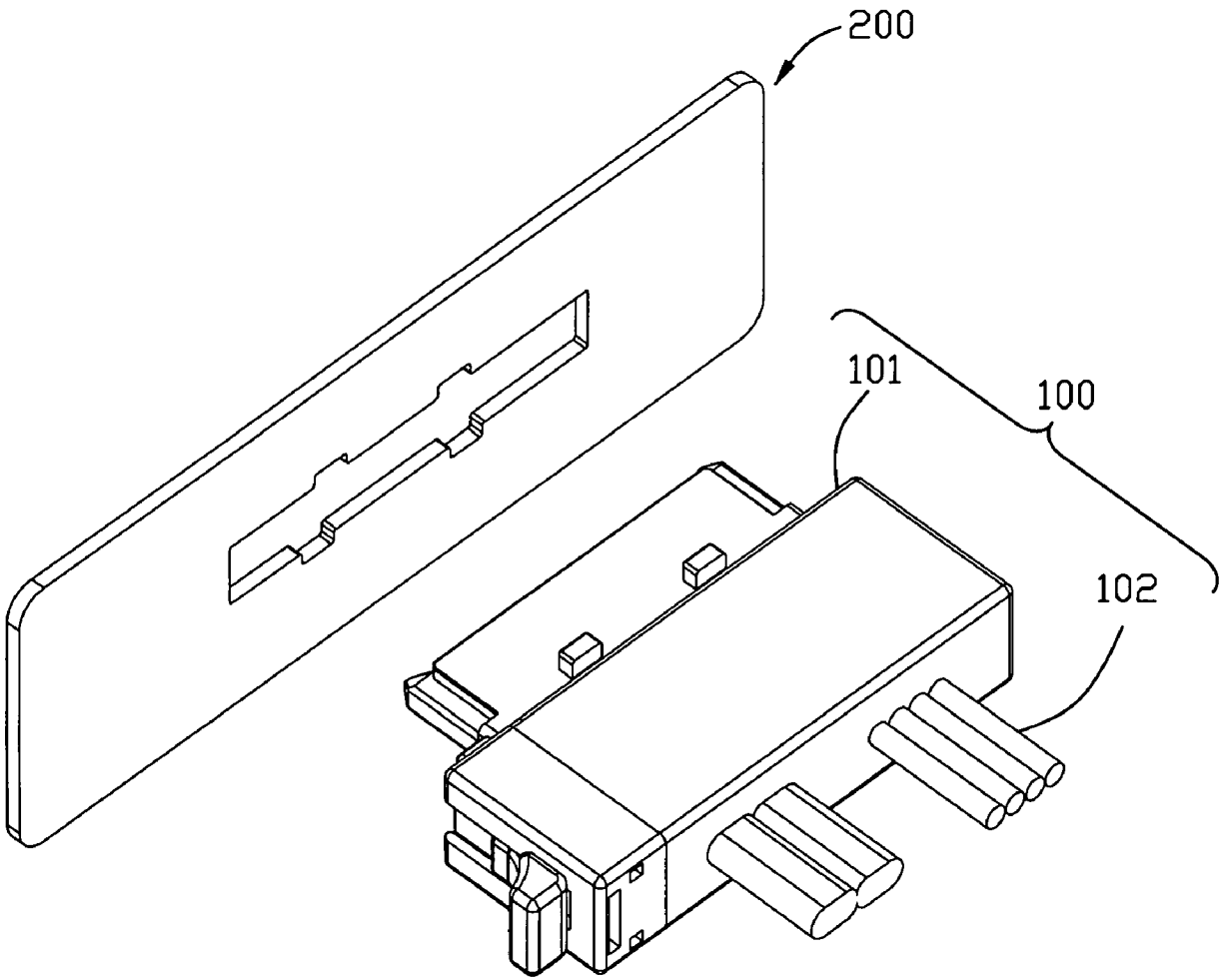
FIG. 2 is similar to FIG. 1, but viewed from other aspect.
Figure 3:
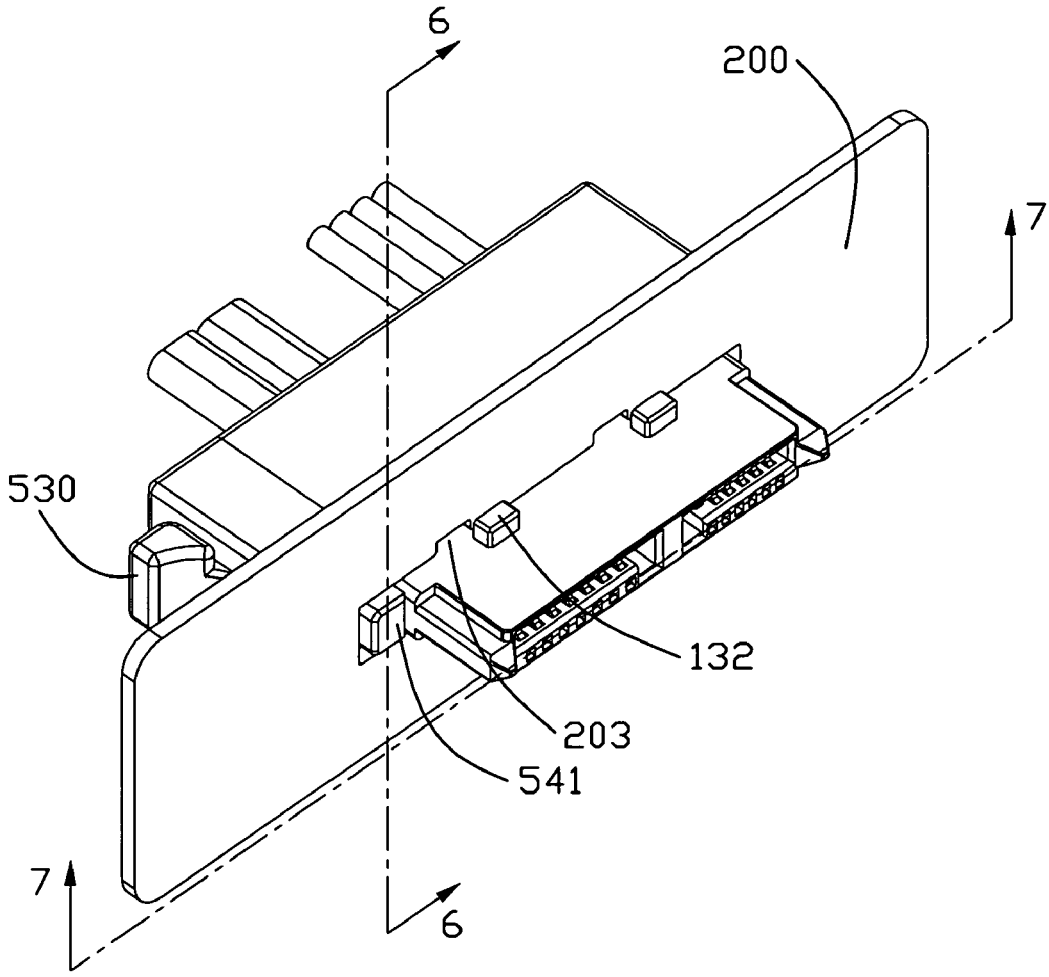
FIG. 3 shows the connector mounted to the panel.
Figure 4:
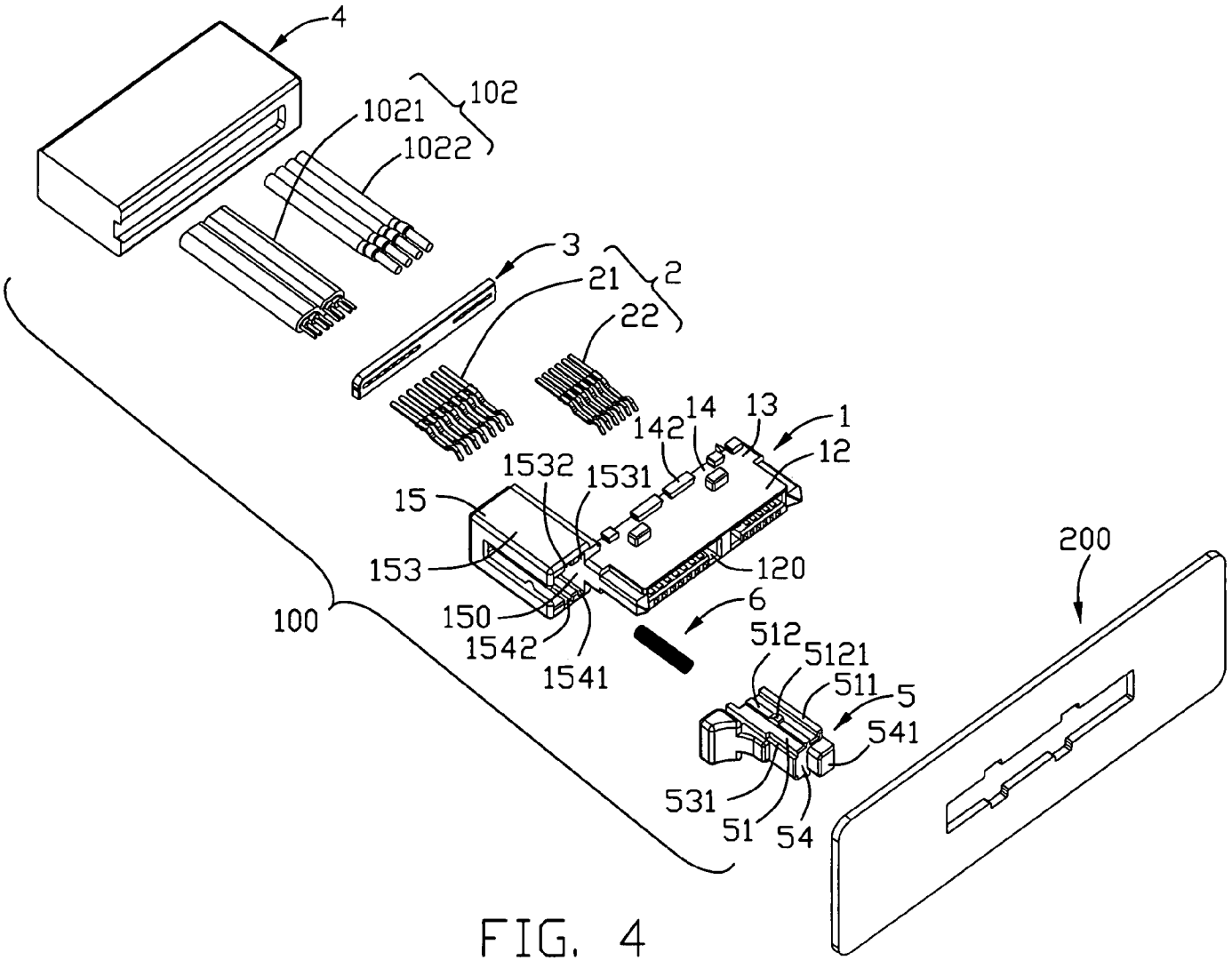
FIG. 4 is an exploded, perspective view of the connector and the panel.
Figure 5:
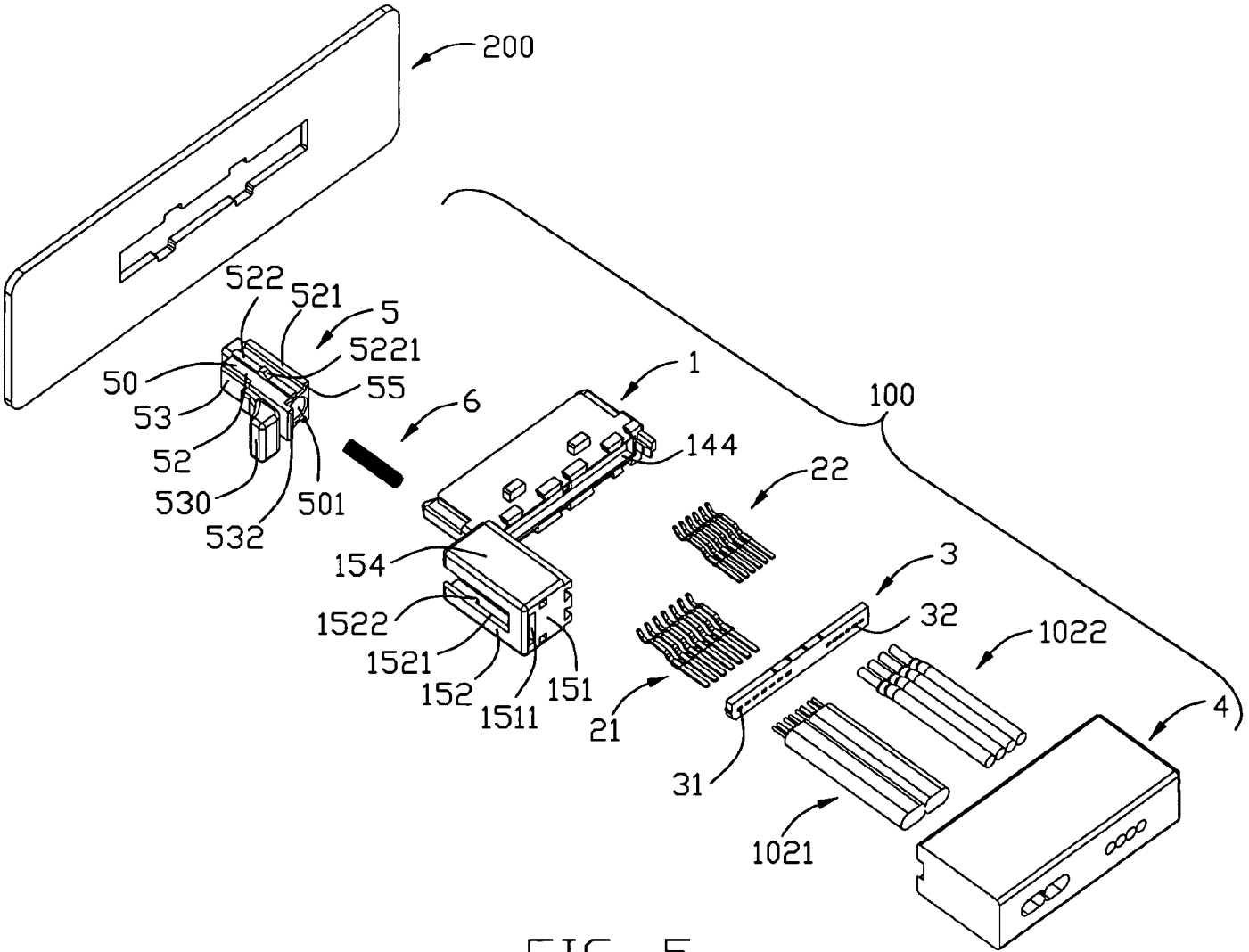
FIG. 5 is similar to FIG. 4, but viewed from other aspect.
Figure 6:
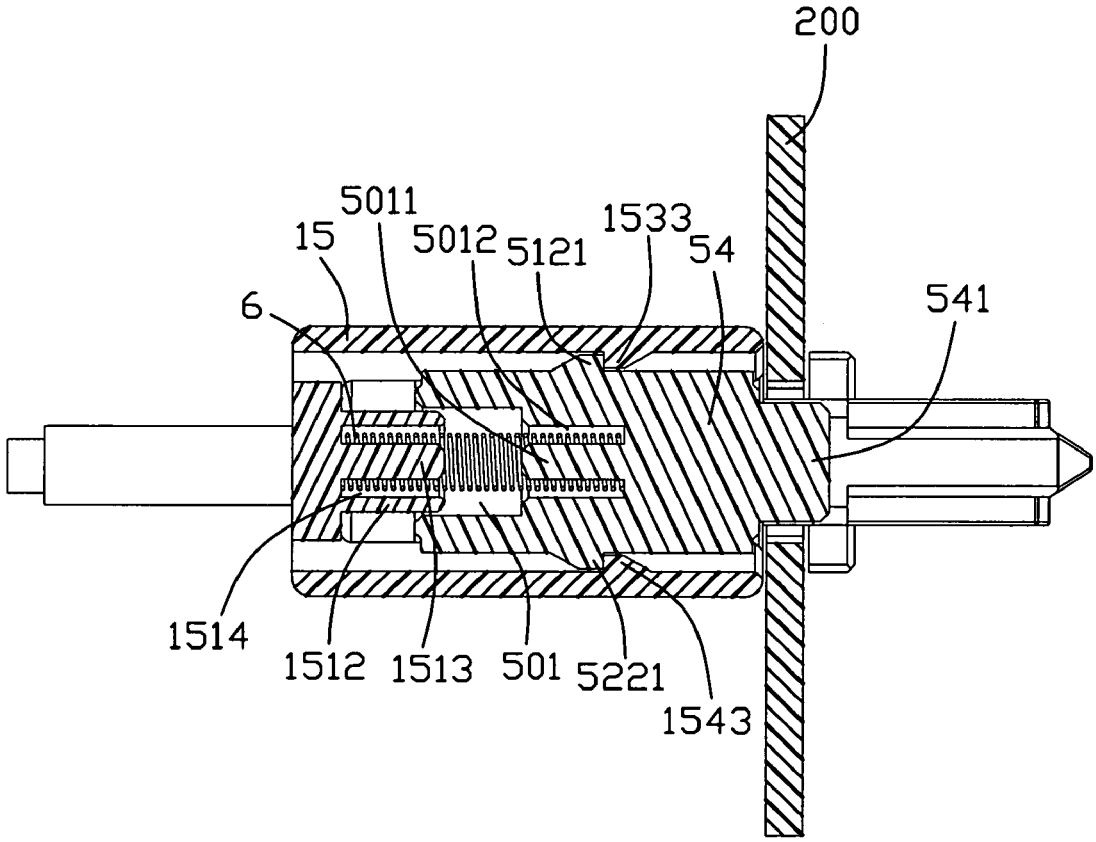
FIG. 6 is a cross-section view of FIG. 3 taken along line 6-6.
Figure 7:
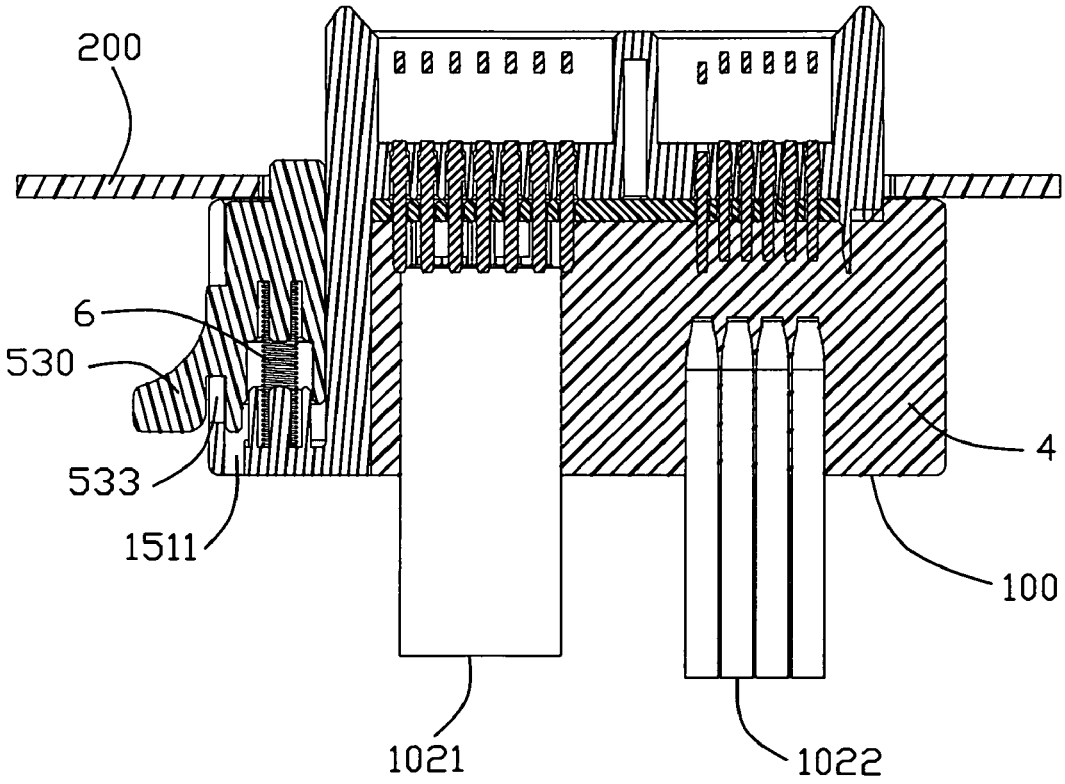
FIG. 7 is a cross-section view of FIG. 3 taken along line 7-7.

Referring to FIGS. 1-7, a cable assembly 100 is adapted to be mounted to a panel 200. The panel 200 may be a side of cage of a computer or other electronic device. The panel 200 includes a body portion 201, an elongated opening 202 through a body portion 201 along a direction perpendicular thereto. A number of cutouts (or apertures) 203 disposed along and in communication to the elongated opening 202.

The cable assembly 100 comprises connector 101 and a plurality of wires 102 coupled thereto.

The connector 101 includes an insulative housing 1, a plurality of contacts 2, a spacer member 3, a cover 4, a slider member 5, and a spring member 6. Detailed description of those element members and their relations are given below.

The insulative housing 1 has an elongated mating portion 12 which is made of a number of walls (not numbered) interconnected together to form a mating port 120 thereamong, a mounting portion 13 connected to a rear face (not shown) of the mating portion 12 and adapted for being accommodated in the opening 202 of the panel 200 and having a dimension along a transversal direction being smaller than that of the opening 202, and a base portion 14 extending rearward from a back face of the mounting portion 13. Two pair of lock tabs 132 are formed at rear sections of a top and a bottom surfaces (not numbered) of the mating portion 12 and disposed adjacent the mounting portion 13. A number of protrusion members 142 are respectively located on a top and a bottom surfaces of the base portion 14. An elongated cavity 144 is recessed forwardly from a back surface of the base portion 14 for receiving the spacer member 3 therein.

A retainer member 15 is connected to a lateral side of the base portion 14 and extends beyond the back surface of the base portion 14. The retainer member 15 defines a passageway 150 extending along a longitudinal direction which is perpendicular to the transversal direction. The passageway 150 has a front outlet (not number), a rectangular-shaped hole 1511 defined in a rear wall 151 of the retainer member 15, and a slit 1521 defined in a lateral wall 152 thereof. Both the hole 1511 and the slit 1521 are in communication to the passageway 150. A pair of first protrusions 1522 are formed on a lower and up sections of an inner surface of the lateral wall 152. A first channel portion 1531 and a second channel portion 1532 are arranged in juxtaposed manner and defined in an inner portion of an up wall 153 and extend along a longitudinal direction, and a bottom wall 154 also has a first channel portion 1541 and a second channel portion 1542 similar to and aligning with the first and second channel portions 1531, 1532 in the up wall 153. A pair of first protruding members 1533, 1543 are respectively formed in a front segments of the second channel portions 1532, 1542.

A cylindrical-shaped alignment member 1512 is formed on an inner surface of the rear wall 151 and extends forwardly along the longitudinal direction. Furthermore, a positioning post 1513 disposed inside of the alignment member 1512 and extends forward from the inner surface of the rear wall 151. The circular shape positioning post 1513 and the alignment member 1512 are arranged in coaxial relationship and parallel to one another. A loop-shaped gap 1514 is formed between the positioning post 1513 and the alignment member 1512. However, it should be noted that the alignment member 1512 and the positioning post 1513 can be other shapes, such as rectangular, ellipse, and the like.

The contacts 2 includes seven signal contacts 21 and six power contacts 22 which are arranged into two distinct rows along the transversal direction. The signal contacts 21 and the power contacts 22 are supported by the insulated housing 1, with mating segments (not numbered) thereof extending into the mating port 120, and tail portions (not numbered) extending rearward to surpass the back surface of the insulated housing 1 and further passing through holes 31, 32 of the spacer member 3. The signal wires 1021 and the power wires 1022 are respectively soldered to the tail portions of the signal contacts 21 and the power contacts 22.

The slider member 5 has a main portion 50 and a handle portion 530 formed on a lateral side 53 thereof. Two first guide members 511, 521 and another two second guide members 512, 522 are respectively formed on a top and a bottom surfaces 51, 52 of the main portion 50. Both the first guide members 511, 521 and second guide members 512, 522 are capable of sliding/moving along the first channel portions 1531, 1541 and the second channel portions 1541, 1542. A pair of second protruding members 5121, 5221 are formed on the first guiding members 511, 521. The second protruding members 5121, 5221 can be blocked/stopped by the first protruding members 1533, 1543 to prevent the slider member 5 sliding away the retainer member 15. A pair of notches 531 are respectively defined in an upper and a lower sections of the lateral side 53 and arranged in the front segment thereof. The pair of first protrusions 1522 are capable of moving along the notches 531 and stopped at ends thereof.

A tab 532 extends rearward from the lateral side 53 and beyond a back surface 55 of the main portion 50. A gap portion 533 is formed between the tab 532 and the handle portion 530. A circular-shaped slot 501 is recessed forwardly from the back surface 55 of the main portion 50. A positioning pole 5011 is disposed in a front segment of the slot 501 and extends rearward from an inner surface of a front wall 54 of the main portion 50, thus a loop-shaped hollow portion 5012 is formed between the positioning pole 5011 and an inner surface of the front segment of the slot 501. A head portion or front end portion 541 is formed on a front surface of the front wall 54. The cover 4 is made of insulative material, such as plastic etc. which is molded over the base portion 14 and front segments of the cables 102 so as to have the contacts 2 and signal wires 1021 and power wires 1022 coupled together securely. The protrusion members 142 of the base portion 14 may enhance combination between the base portion 14 and the cover 4.

The slider member 5 is assembled to and held by the retainer member 15, with main portion 50 received in the passageway 150, the handle portion 530 disposed outward of the lateral wall 152 and capable of moving along the slit 1521. Furthermore, the positioning pole 5011 and the positioning post 1513 are inserted into a front segment and a rear segment of an internal of the spring member 6. The spring member 6 can push the slider member 6 forward movement to have header portion 541 exposed outward of a front surface of the retainer member 15 and located at a lateral side of the mounting portion 13. When a rearward force is exerted onto the handle portion 530 of the slider member 5, the alignment member 1512 slides into a front segment of the slot 501, and the spring member 6 is compressed and the header portion 541 of slider member 5 retracts into the passageway 150.

When the connector 101 is mounted to the panel 200, the mating portion 12 is firstly inserted into the opening 202 and the head portion 541 is pushed backwardly by the panel 200, then the lock tabs 132 pass through the cutout 203. Secondly, the connector 101 is moved along a transversal direction, and the header portion 541 extends into the opening 202 automatically by resilient force of the spring member 6, thus the mounting portion 13 and the header portion 541 are both accommodated in the opening 202 to inhibit the mounting portion 13 movement along the opening within a certain range such that the lock tabs 132 can't exit out of the opening 202 arbitrarily, therefore the lock tabs 132 and the cover 4 and the retainer member 15 arranged at opposite sides of the panel 200 such that the connector 101 is securely attached to the panel 200. When the connector 101 is detached from the panel 200, a rearward force is exerted to the handle portion 530 of the slider member 5 to have header portion 541 retract into the passageway 150, and the connector 101 is laterally moved to have the lock tabs 132 exit through cutouts 203.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A connector adapted for mounting to a panel, comprising:

an insulative housing including a mating portion, a mounting portion extending rearward from the mating portion, at least a lock tab formed on a top or a bottom surface of the mating portion and disposed adjacent to the mounting portion;

a retainer member connected to a lateral side of the insulative housing, said retainer member having a passageway extending along a longitudinal direction and a slit defined in a lateral side of the retainer member and in communication to the passageway;

a slider member including a main portion and a handle portion formed on a lateral side of the main portion, said main portion accommodated in the passageway and the handle portion disposed outside of the passageway and capable of moving along the slit; and a spring member received in the passageway and capable of pushing the main portion sliding along the longitudinal direction to reach a lateral side of the mounting portion.

2. The connector as recited in claim 1, wherein the slider member includes at least a guide member on a top or a bottom surfaces thereof, and a corresponding channel portion is defined in an inner portion of an up or a bottom walls of the retainer member to receive the guide member.

3. The connector as recited in claim 2, wherein a first protruding member is formed on the slider member and a second protruding member is arranged in the corresponding channel portion blocking the first protruding member to prevent the guide member sliding away the retainer member.

4. The connector as recited in claim 1, wherein at least a notch portion defined in a front segment of a lateral side of the slider member, and a corresponding protrusion is formed on an inner surface of the lateral side of the retainer member and capable of sliding along the notch portion.

5. The connector as recited in claim 1, wherein an alignment member is disposed in the passageway and formed on an inner surface of a rear wall of the retainer member, and a slot is recessed forwardly from a back surface of the main portion of the slider member to receive the alignment member.

6. The connector as recited in claim 5, wherein a poisoning pole is disposed in a front segment of the slot and extends rearward from an inner surface of a front wall of the slider member, and positioning post is disposed inside the alignment member and extends forwardly from the rear wall of the retainer, wherein the positioning pole and the positioning post respectively are inserted into the spring member from opposite sides.

7. The connector as recited in claim 1, wherein the insulated housing further comprises a base portion extending rearward from the mounting portion.

8. The connector as recited in claim 7, wherein at least a protrusion member is formed on the base portion, and a cover is molded over the base portion to have the protruding member enclosed therein.

9. The connector as recited in claim 7, wherein an elongated cavity is recessed forwardly from a back surface of the base portion to receive a spacer.

10. A cable assembly adapted to be mounted to a panel, said panel defining an opening and at least a cutout arranged along and in communication with the cutout, comprising:

a connector having a mating portion and at least a lock tab formed on one side of the mating portion, said connector mounted to the panel, with the mating portion inserted into the opening, the lock tab extending into the cutout and disposed forwardly of the panel;

a retainer member connected to a lateral side of the connector and disposed rearward of the panel, said retainer member having a passageway extending along a longitudinal direction, and a slider member partially received in the passageway;

a spring member received in the passageway and capable of pushing the slider member moving along the longitudinal direction; and whereas movement the connector along another direction perpendicular to the longitudinal direction to allow the lock tab offsetting the cutout and a front end of the slider member extending into the opening of the panel such that the connector and the panel are latched together.

11. The cable assembly as recited in claim 10, wherein a handle portion is integrated with the slider member and accessible from an external.

12. The cable assembly as recited in claim 11, wherein a slit is defined in a lateral side of the retainer, and the handle portion is capable of sliding along the slit.

13. The cable assembly as recited in claim 10, wherein a slot is recessed forwardly from a back surface of the slider member, and an alignment member is disposed in the passageway and formed on an inner side of a rear wall of the retainer, and wherein the alignment member is capable of sliding along the slot.

14. The cable assembly as recited in claim 13, wherein a positioning pole is disposed in a front segment of the slot and extends rearward from an inner surface of a front wall thereof, and a positioning post is disposed inside of the alignment member and extend forwardly from an inner surface of the rear wall thereof, and wherein the positioning pole and the positioning post are respectively inserted into a front part and a rear part of the spring member.

15. The cable assembly as recited in claim 10, wherein at least a guide member is formed on a top or a bottom surface of the slider member, and a corresponding channel portion is defined in an inner portion of an up or a bottom walls of the retainer member to receive the guide member.

16. The cable assembly as recited in claim 15, wherein a first protruding member is formed on the slider member and a second protruding member is arranged in the corresponding channel portion blocking the first protruding member to prevent the guide member sliding away the retainer member.

17. A cable connector assembly comprising:

a panel defining an opening;

an electrical connector including:

an insulative housing defining a base section with a mating portion extending forwardly therefrom;

a plurality of contacts disposed in the housing;

a plurality of wires electrically connected to the corresponding contacts, and extending on a rear side of the housing;

a slider member being a part of the connector and moveable relative to the housing in a front-to-back direction, said slider member defining a header portion located at a front end and in-and-out moveable with regard to the opening, and an operation portion associated with the slider member to move said slider member along said front-to-back direction; and a biasing device constantly urging the slider member toward a forward locking position; wherein the mating port is configured and dimension to be forwardly inserted through the opening when said mating port is located at a first transverse position and the slider is located in a rearward position, and is successively moved to a second transverse position in a transverse direction where at least a portion of the mating port abuts against the panel in the front-to-back direction so as to prevent the mating portion from being rearwardly withdrawn from the opening under a condition that the header portion is received in the opening to prevent the mating port from moving from the second transverse position back to the first transverse position.

18. The assembly as claimed in claim 17, wherein said connector includes a retainer member to hold the biasing device and said slider member therein.

19. The assembly as claimed in claim 17, wherein said biasing device is a spring.

20. The assembly as claimed in claim 17, wherein the operation portion is unitarily formed on the slider member.

* * * * *